US008963670B2

(12) United States Patent
Larsson et al.

(10) Patent No.: US 8,963,670 B2
(45) Date of Patent: Feb. 24, 2015

(54) TAP CHANGER

(71) Applicants: Tommy Larsson, Ludvika (SE); Richard Mannerbro, Vasteras (SE); Jean Mathae, Ludvika (SE)

(72) Inventors: Tommy Larsson, Ludvika (SE); Richard Mannerbro, Vasteras (SE); Jean Mathae, Ludvika (SE)

(73) Assignee: ABB Technology Ltd. (CH)

( * ) Notice: Subject to any disclaimer, the term of this patent is extended or adjusted under 35 U.S.C. 154(b) by 0 days.

(21) Appl. No.: 14/046,604

(22) Filed: Oct. 4, 2013

(65) Prior Publication Data

US 2014/0034464 A1 Feb. 6, 2014

Related U.S. Application Data

(63) Continuation of application No. PCT/EP2012/053663, filed on Mar. 2, 2012.

(30) Foreign Application Priority Data

Apr. 4, 2011 (EP) ..... 11161015

(51) Int. Cl.

| | |
|---|---|
| ***H01F 21/12*** | (2006.01) |
| ***H01F 29/06*** | (2006.01) |
| ***H01F 21/02*** | (2006.01) |
| ***H01H 19/00*** | (2006.01) |
| ***H01H 9/00*** | (2006.01) |
| *H01H 9/48* | (2006.01) |
| *H01H 50/10* | (2006.01) |

(52) U.S. Cl.

CPC ..... *H01H 9/0005* (2013.01); *H01H 9/0016* (2013.01); *H01H 9/48* (2013.01); *H01H 50/10* (2013.01)

USPC ..... 336/150; 336/149; 336/138; 200/11 TC

(58) Field of Classification Search

USPC ..... 336/150, 138, 137, 149, 84 C; 200/11 TC, 16 D, 16 F, 279, 501; 363/100, 340, 131

See application file for complete search history.

(56) References Cited

U.S. PATENT DOCUMENTS

| | | | | |
|---|---|---|---|---|
| 3,818,402 | A * | 6/1974 | Golaski et al. | 336/147 |
| 7,852,650 | B2 * | 12/2010 | Taylor et al. | 363/100 |
| 2012/0241300 | A1 * | 9/2012 | Brasher et al. | 200/5 B |

FOREIGN PATENT DOCUMENTS

| | | | |
|---|---|---|---|
| DE | 2301778 | A1 | 7/1974 |
| DE | 3621644 | A1 | 1/1988 |
| GB | 887369 | A | 1/1962 |

OTHER PUBLICATIONS

European Search Report Application No. EP 11 16 1015 Completed: Aug. 2, 2011 4 pages.

International Preliminary Report on Patentaility Application No. PCT/EP2012/053663 Completed: Mar. 7, 2013 12 pages.

International Search Report and Written Opinion of the International Searching Authority Application No. PCT/EP2012/053663 Completed: Jun. 18, 2012; Mailing Date: Jul. 4, 2012 6 pages.

* cited by examiner

*Primary Examiner* — Mangtin Lian

(74) *Attorney, Agent, or Firm* — St. Onge Steward Johnston & Reens LLC

(57) ABSTRACT

A tap changer for connection to a regulating winding of a rated regulation voltage is provided. The tap changer having a linear tap selector having at least one current collector and a linear arrangement of fixed contacts. Tap changer further includes a shielding structure arranged to shield the tap selector from an external electrical field. The shielding structure includes: a first shielding part arranged to be electrically connected to a current collector; and a second shielding part formed at least partly by the fixed contacts. The first and second shielding parts are separated so that the distance between the first and second shielding parts reaches or exceeds the rated regulating voltage insulation distance of the tap changer.

19 Claims, 9 Drawing Sheets

TAP CHANGER

FIELD OF THE INVENTION

The present invention relates to the field of power transmission, and in particular to tap changers for controlling the output voltage of a transformer.

BACKGROUND OF THE INVENTION

Tap changers are used for controlling the output voltage of a transformer by providing the possibility of switching in or switching out additional turns in a transformer winding. A tap changer comprises a set of fixed contacts which are connectable to a number of taps of a regulating winding of a transformer, where the taps are located at different positions in the regulating winding. A tap changer further comprises a moveable contact which is connected to a current collector at one end, and connectable to one of the fixed contacts at the other end. By switching in or out the different taps, the effective number of turns of the transformer can be increased or decreased, thus regulating the output voltage of the transformer. Tap changers are generally customized for a particular application, especially when the tap changer is intended for higher transformer voltage ratings. Thus, each high voltage tap changer design is typically produced in very small volumes only. The design of the tap changer, as well as the adaptation of the manufacturing process, is time consuming.

SUMMARY OF THE INVENTION

A problem to which the present invention relates is how to obtain a versatile yet compact design of a tap changer.

This problem is addressed by a tap changer for connection to a regulating winding of a rated regulation voltage, the regulating winding having a set of taps. The tap changer has a tap selector, which comprises a set of fixed contacts of at least two fixed contacts, each fixed contact arranged to be connected to a tap of the regulating winding. The tap selector further comprises at least one current collector. The tap selector also comprises at least one movable contact part having a moveable contact arranged to electrically bridge a contact gap between a current collector and a fixed contact. The moveable contact is arranged to bridge the contact gap at one fixed-contact position at a time, i.e. to be electrically connected to one of the taps at a time.

The tap changer further comprises a shielding structure arranged to shield the tap selector from an external electrical field. The shielding structure comprises a first shielding part arranged to be electrically connected to the connected tap of the regulating winding; and a second shielding part formed at least partly by the fixed contacts. The first and second shielding parts are separated so that the distance between the first and second shielding parts reaches or exceeds the rated regulating voltage insulation distance of the tap changer.

The rated regulating voltage insulation distance of the tap changer is typically defined as the distance over which the insulation medium of the tap changer can sustain the voltage obtained between a current collector and a fixed contact at the rated lightning impulse voltage. The regulating voltage insulation distance of the tap changer is typically a function of position along the extension direction of the arrangement of fixed contacts. The distance between the first and second shielding parts does at no location along this direction go below the local regulating voltage insulation distance of the tap changer.

In one embodiment, the fixed contacts are linearly arranged. The current collector(s) are arranged in parallel with the linear arrangement of fixed contacts, at a first distance from the linear arrangement of fixed contacts, said first distance forming the contact gap.

By providing a shielding structure which shields the tap selector from the external electric field, the dimensioning of the contact gap can be based mainly on the regulation voltage insulation distance, while the effects from the external electric field can be neglected, or will at least influence the design to a much lesser extent. Hence, a general design of the tap changer can be employed for many different applications. By using a shielding structure which comprises two parts, where one of the parts is formed at least partly by the fixed contacts, and the other is arranged to be at the potential of the connected tap, a compact design of a shielded tap changer can be achieved.

At least a major part of the first shielding part will typically be arranged on the farther side of the current collector(s) as seen from the arrangement of fixed contacts. Hereby is achieved that the current collector(s) will be efficiently shielded. However, an embodiment wherein the first shielding part does not extend beyond the current collector(s) in a direction along the contact gap can also be contemplated, where typically, if there are more than one current collector, the first shielding part will be separated into more than one section, each section being connected to a respective one of the current collectors.

The space formed between the current collector and the arrangement of fixed contacts can advantageously contain no conducting parts, apart from conducing parts forming part of the moveable contact part. Hereby is achieved that this space can be compactly designed.

The moveable contact part could comprise at least one shielding plate arranged between the moveable contact and the exterior of the tap changer, in order to shield the movable contact from the external electrical field. Hereby is achieved that the moveable contact will be efficiently shielded from the external field despite the opening between the first and second contact parts. A design of the moveable contact part which is less careful in terms of voltage grading can thus be allowed.

The second shielding part could comprise a set of fixed-contact shields, where each fixed-contact shield is arranged to shield a fixed contact. Such fixed-contact shield has a curvature in the contact gap plane with a convex surface facing away from the fixed-contact towards the tap changer exterior, and the fixed-contact shields are electrically separated from each other. The fixed-contact shield could, in one implementation of this embodiment, be integrated with the fixed contacts.

The first shielding part could comprise an edge shield having a curvature in the contact gap plane with a convex surface facing away from the current collector towards the tap selector exterior, the edge shield extending along a direction parallel to the current collector(s).

The first shielding part could comprise a top and/or a bottom shielding part, where the top/bottom shielding part extends out of the current collector plane, towards the linear arrangement of fixed contacts, at a position along the extension direction which lies beyond the position of the end fixed contact. Such top/bottom shielding part has a convex surface facing away from the fixed contacts and the current collector(s) towards the tap changer exterior.

In one embodiment, all conducting parts of the tap changer are arranged to be, when the tap changer is in use, at an electrical potential within the potential range of the regulating winding. Hereby is achieved that neither potential differences between each tap and ground, nor between taps of different phases, has to be taken into consideration in the tap changer design. The tap changer design can then focus on the potential differences within the regulating winding potential range.

In one embodiment, the tap changer is arranged so that no part of the tap changer will have to be at earth potential. Hereby is achieved that the versatility of the tap changer is increased. This can for example be achieved by providing the tap changer with electrically insulating attachment means for attaching the tap changer to an insulating structure.

The tap changer can for example be a diverter switch tap changer having a diverter switch. When the tap changer comprises a diverter switch, the first shielding part can be arranged to shield at least part of the diverter switch, the diverter switch being located in a space between the first shielding part and the current collector, behind the current collector as seen along a contact plane from the arrangement of fixed contacts.

In one implementation, the tap changer further comprises an electrically insulating structure arranged to prevent undesired matter from entering the tap selector, in order to prevent flashover and other problems. This insulating structure forms an enclosure (possibly together with parts of the shielding structure), which mechanically separates the inside of (at least) the tap selector from the exterior.

The invention is particularly beneficial for an air-insulated on-load tap changer, but can advantageously also be used in other types of tap changers.

Further aspects of the invention are set out in the following detailed description and in the accompanying claims.

DETAILED DESCRIPTION OF THE INVENTION

Figure 1:
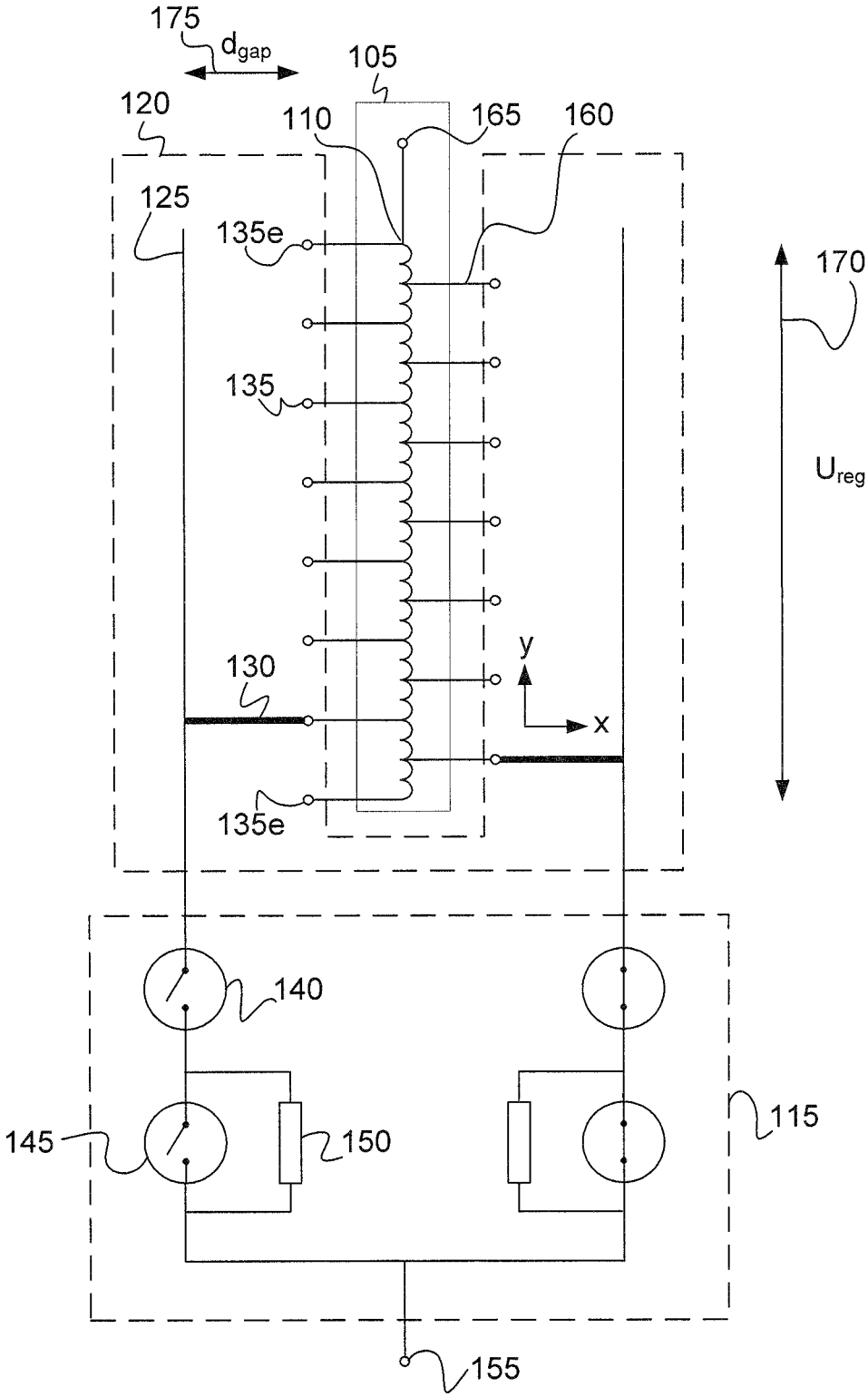
FIG. 1 is a schematic illustration of an example of a tap changer of diverter switch type.

FIG. 1 schematically illustrates a tap changer 100 which is connected to a regulating winding 105 having a set of different taps 110. The tap changer of FIG. 1 is of diverter switch type, and comprises a diverter switch 115 and a tap selector 120. The tap selector 120 of FIG. 1 comprises two current collectors 125, two moveable contacts 130 and a set of fixed contacts 135, where each fixed contact 135 is arranged to be connected to one of the taps 110 of the regulating winding. A tap selector 120 has two or more fixed contacts 135. The tap changer 100 of FIG. 1 has fifteen different fixed contacts 135, and the regulating winding 105 has fifteen taps 110. The tap changer 100 of FIG. 1 is mechanically linear in the sense that the current collectors 125 are implemented as linear rods, and the fixed contacts 135 are arranged in a linear fashion. In the following, the term linear tap changer should be construed as a mechanically linear tap changer, unless stated otherwise. The two current collectors 125 together form a current collector part. In a tap changer 100 having a single current collector 125, the current collector part is formed by the single current collector 125, etc.

The diverter switch 115 comprises two series connections of a main contact 140 and a transition contact 145, with transition resistor 150 connected in parallel with transition contact 145. Each of the series connections are, at one end, connected to a respective one of the two current collectors 125, and, at the other end, connected to an external contact 155 of the tap changer 100.

The two moveable contacts 130 are, at one end, in electrical contact with a respective one of the current collectors 125. A moveable contacts 130 can move along the current collector 125 to which it is connected, in order to reach different positions, at which the other end of the moveable contact 130 is in electrical contact with one of the fixed contacts 135. The moveable contacts 130 could for example be sliding contacts arranged to slide along the current collectors 125, to allow for electrical connection between the current collectors 125 and the different fixed contacts 135. The driving of the moveable contacts 130 of FIG. 1 is arranged so that if one of the moveable contacts 130 is in contact with a fixed contact 135, connected to a first tap, the other moveable contact 130 is in contact with a fixed contact 135, connected to a tap 110 which is adjacent to the first tap 110.

By switching the main contacts 140 and transition contacts 145 in a conventional manner, one or the other of the moveable contacts 130 will be in electrical contact with the external contact 155, and thus provide an electrical path through the tap changer 100. Similarly, the two current collectors 125 will take turns at being part of the electrical path of the tap changer 100. The electrical path through the tap changer 100 ends at the external contact 155 at one end, and at the fixed contact 135 that is currently connected at the other end. An example of a diverter switch 115 is described in EP0116748. The diverter switch 115 of FIG. 1 is an example only, and any suitable type of diverter switch 115 can be used.

As mentioned above, the regulating winding 105 has a set of taps 110, which are shown to be connected to the fixed contacts 135 of the tap changer 100 via cables 160. The other end of the regulating winding 105 is provided with an external contact 165. Depending on which tap 110 is currently connected to a fixed contact 135, the electrical path between the external contacts 155 and 165 will include a different number of the regulating winding turns. The regulating winding 105 is often not seen as part of the tap changer 100, and has therefore been surrounded by a solid line in FIG. 1.

When the tap changer 100 is in use, the different fixed contacts 135 will be at different potential levels, corresponding to the different potential levels of the different taps 110 of the regulating winding 105. The current collector 125, which is currently connected, will be at the potential of the connected tap 110, while the other current collector 125, which is currently disconnected, will be at the potential of the tap 110 which is adjacent to the connected tap 110. Thus, the potential difference between the current collectors 125 will correspond to the potential difference between two adjacent taps 110, $U_{adj}$. $U_{adj}$ is typically constant throughout the regulating winding 105. Only one tap 110 at a time will be connected to the moveable contact 130 which is currently connected to the external connection 155 of the tap changer, this tap 110 being referred to as the connected tap 110.

The potential difference between a current collector 125 and a particular fixed contact 135, on the other hand, varies depending on at which position the moveable contact 130 is connected, and could be considerably larger. In a linear tap changer 100, the maximum potential difference between a current collector 125 and a fixed contact 135 occurs when one of the end fixed contacts 135, denoted 135*e* in FIG. 1, are connected and forms part of the current path through the tap changer 100. In this case, the potential difference between the current collector 125 that is connected, and the end fixed contact 135*e* which is not connected, corresponds to the entire voltage across the regulating winding 100, $U_{reg}$. $U_{reg}$, also referred to as the regulation voltage, is illustrated in FIG. 1 by arrow 170. In order to prevent flashover between the current collectors 125 and the fixed contacts 135, the distance between the current collectors 125 and a fixed contacts 135 should reach or exceed the minimum distance over which the medium, in which the tap changer 100 is immersed, can withstand the voltage obtained, at a particular regulation voltage $U_{reg}$, between the current collector and the fixed contact 135 at the position of the moveable contact 130 which yields the highest voltage between the current collector 125 and the fixed contact (which position of the moveable contact 130 yields the highest voltage varies between the different fixed contacts). This distance, denoted $d_{insul}$ and hereinafter referred to as the rated regulation voltage insulation distance of the tap changer, or insulation distance for short, depends on the medium surrounding the tap selector 120, and increases with increasing rated regulation voltage (which typically depends on the rated voltage of the transformer and the desired number of taps 110). Furthermore, the insulation distance $d_{insul}$ of the tap changer typically varies along the length of the tap changer 100, so that $d_{insul}=d_{insul}(y)$, where y denotes a position along the extension direction of the linear tap changer. The largest possible potential difference between the current collectors 125 and the fixed contacts 135 can occur at the end fixed contacts 135*e*, and the nearer the centre of the arrangement of fixed contact(s) 135, the smaller the maximum potential difference between the current collector 125 and the fixed contacts 135. The insulation distance at the end fixed contacts 135*e* is denoted $d_{insul}^{end}$. The regulation voltage used for defining the insulation distance is often a test voltage and are one of the parameters for which the tap changer 100 is rated.

The actual distance between the current collectors 125 and the fixed contacts 135 will hereinafter be referred to as the contact gap, $d_{gap}$, and is indicated in FIG. 1 by arrow 175. The contact cap in FIG. 1 is shown to be independent of position y along the extension direction. This represents a typical design, where the contact gap $d_{gap}$ is constant and approximately correspond to $d_{insul}^{end}$. However, a contact gap $d_{gap}=d_{gap}(h)$ that varies with position along the extension direction, for example such that $d_{gap}(h)$ is smaller toward the centre of the tap changer 130, could be beneficial in some circumstances.

In a tap changer 100 that is air insulated, the contact gap $d_{gap}$ needs to be considerably larger than in an oil insulated tap changer 100. For example, in an air insulated tap changer 100 wherein the insulation distance is 30 cm, the corresponding insulation distance could typically be around 3 cm in an oil insulated tap changer. Thus, an air insulated tap changer 100 typically needs to be physically larger than if the tap changer 100 were insulated by means of oil. However, in many applications, air insulation is preferred over oil insulation, such as inside buildings, where the risk of fire should be minimized (e.g. in a skyscraper), or in environmentally sensitive areas, where the risk of contamination should be minimized. The term air insulated tap changer 100 should here be construed to include tap changers 100 which are insulated by air or by air-like gases in a controlled space, such as tap changers 100 insulated by nitrogen gas ($N_2$), tap changers 100 insulated by air at a controlled pressure, tap changers 100 insulated by SF6, etc.

The potential difference between the current collectors 125 and the fixed contacts 135 will further be influenced by the surrounding electrical fields. In a three phase power system, a tap changer 100 is typically part of a three-phase tap-changer system comprising three different tap changers 100 connected to the three phases of a three phase transformer. Hence, the electrical field at the tap changer 100 will be influenced by the electric fields surrounding the other two phases of the tap changer system 100, and the transformer to which the tap changer 100 is connected, as well as by other electric fields. For example, the potential difference between the current collectors 125 and the fixed contacts 135 will be influenced by earth potential. Thus, the contact gap $d_{gap}$ should be large enough to allow for a potential difference caused by internal electrical fields originating from the regulation voltage $U_{reg}$, and which is superposed onto the external electric fields. Since the external electric field will vary from application to application, depending on the insulation requirement to ground and between phases, the dimensioning of the contact gap and other parts of the tap changer 100 will generally have to be customized to the requirements of each application. This results in costly manufacturing of tap changers 100.

Figure 2:
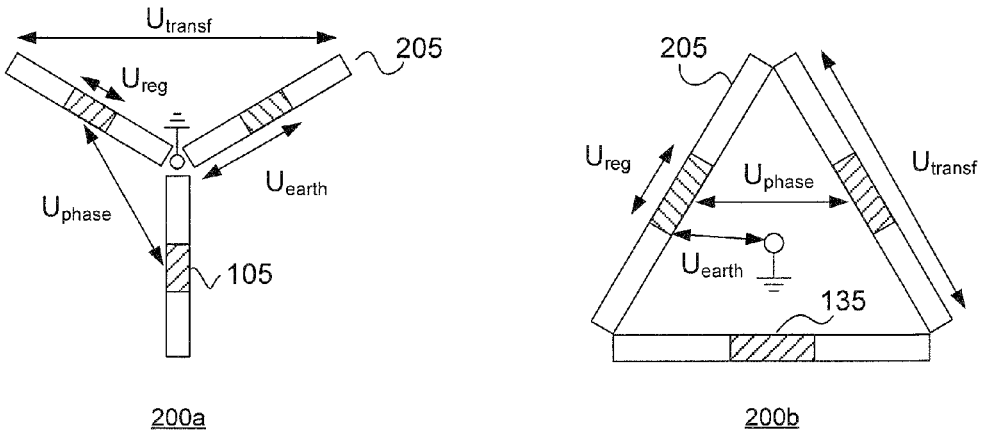
FIG. 2 illustrates two three-phase transformers of Y- and Δ-configuration, respectively, where the three-phase transformers are provided with regulating windings.

FIG. 2 illustrates two different three phase transformers 200*a* and 200*b*, respectively, wherein transformer 200*a* is a Y-connected three phase transformer, while transformer 200*b* is a Δ-connected three phase transformer, each transformer having three transformer phases 205. In the following, a transformer in general, without reference to its configuration, will be referred to by reference numeral 200. Each transformer phase 205 has a regulating winding 105. In the configurations shown in FIG. 2, the regulating winding 105 is located in the centre of an (inner or outer) transformer winding—this is given as an illustrative example only, and the regulating winding 105 could have an alternative position, for example at one of the transformer winding ends. In FIG. 2, various potential differences occurring in a three phase transformer 200 are indicated: $U_{reg}$, as presented above, represents the voltage across the entire regulating winding 105; $U_{transf}$ is the voltage between two phases of the transformer; $U_{phase}$ is the voltage between two regulating windings serving two different transformer phases 205; and $U_{earth}$ is the (highest) potential of the regulating winding 105. No tap changers 100 are shown in FIG. 2—typically, one tap changer 100 will be connected to each regulating winding 105 of a transformer 200, although configurations wherein a single tap changer 100 can be used for the regulation of three transformer phases 205 also exist. The potential of the tap selector 120 of a tap changer 100 lies within the potential range of the regulating winding 105 to which it is connected, i.e. within the range $[U_{earth}; U_{earth}-U_{reg}]$.

Insulation distances in high voltage AC equipment are normally dimensioned in view of rated lightning impulse levels. A rated lightning impulse voltage level for a particular value of the highest voltage for equipment, $U_m$, can be found in standards such as IEC 60214-1. A rated lightning impulse voltage found in the standards is valid for insulation to ground and for insulation between phases. The rated impulse voltage level over the regulating winding 135 will to some extent depend on the rating of the transformer 200, but do also depend on the placement and size of the regulating winding 135. During impulse voltages, capacitance from the regulating winding 135 to the surrounding (especially from the free end created as the moveable contact 130 approaches the external contact 165), as well as capacitance within the regulating winding 135 itself, will play a more important role than the transformer magnetic circuit. A tap changer 100 is therefore normally rated for a specific impulse voltage level over the regulating winding 135, here referred to as a rated regulation voltage, as well as for a specific $U_m$ related to the distance to ground.

According to the invention, a tap changer 100 is provided which comprises a shielding structure which is arranged to shield the tap selector 120 (and possibly other parts of the tap changer 100) from an external electric field.

By including a shielding structure in the tap changer, where the shielding structure is arranged to shield the tap selector 120 from the external electric field, the dimensioning of the contact gap can be based mainly on the regulation voltage insulation distance, $d_{insul}$, while the effects from the external electric field can be neglected, or will at least influence the design to a much lesser extent. The tap changer design can be focused mainly on a rated regulation voltage, while the same tap changer 100 could be used for a broader range of $U_m$, since the external isolation (between ground and between phases, when applicable, is separated from the internal isolation (over the regulating winding 135). Hence, a general design of the tap changer 100 can be employed for many different applications.

The shielding structure according to the invention comprises a first shielding part, which is arranged to be electrically connected to the connected tap 110, and a second shielding part, which is at least partly formed by the fixed contacts 135. The first and second shielding parts are separated so that the distance between the first and second shielding parts reaches or exceeds the rated regulation voltage insulation distance. As discussed above, this distance typically varies along the extension direction of the arrangement of fixed contacts. The distance between the first and second shielding parts could be constant over the region of the fixed contacts 135, or could vary, for example so that the distance is smaller for the centre fixed contacts 135 than for the fixed contacts 135 towards the ends of the linear arrangement. When the distance between the first and second shielding parts is constant, this distance should reach or exceed $d_{insul}^{end}$.

The potential of the second shielding part is not constant throughout space when the tap changer 100 is in use, since the different fixed contacts 135 which are part of the second shielding part will be at different potentials. Only one of the fixed contacts 135 will be at the same potential as the first shielding part (or, if the first shielding part is divided into two sections, two of the fixed contacts will be at a respective one of the potentials of the first shielding parts). Thus, there will be a potential difference within the shielding structure. The distance between adjacent fixed contacts 135 could be selected, in a conventional manner, to be at or above an adjacent-fixed-contact-insulation distance.

By using a shielding structure which comprises two parts, where one of the parts is formed at least partly by the fixed contacts 135, and the other is arranged to be at the potential of the connected tap 110, a compact design of a shielded tap changer 100 can be achieved. In high voltage applications, where the physical size of the tap changer 100 is large, compactness is often of high importance. As mentioned above, this is particularly relevant in air insulated tap changers 100, where the insulation distance is of considerable magnitude. In comparison, if a shielding structure of a single potential were to be used, the location of this shielding would have to be such that the distance between this single-potential shielding structure, and all parts of the tap changer 100 which can be at a different potential, reaches or exceeds the applicable insulation distance. For many parts, this means the rated regulation voltage insulation distance of the tap changer, $d_{insul}$. Thus, the physical size of a tap changer 100 having a single-potential shielding structure would have to be considerably larger.

By realizing that the fixed contacts 135 can adequately contribute to the shielding of the tap selector 120; that a shielding structure having an opening comparable to the insulation distance $d_{insul}$ would generally still provide adequate external shielding; and that from a shielding point of view, the potential difference between the two end fixed contacts 135*e* is generally small, compared to the potential difference between a fixed contact 135 and objects in the surrounding, we have arrived at a compact design which provides adequate shielding. The compactness is achieved since the shielding structure is open and the potential throughout the shielding structure varies, so that the insulation distance between the fixed contacts 135 and the current collectors 125 is built-in in the shielding structure.

The first shielding part is mainly for shielding the tap selector 120 from external fields occurring behind the current collectors 125 as seen from the fixed contacts 135, while the second shielding part is mainly for shielding the tap selector 120 from external fields occurring behind the fixed contacts 135 as seen from the current collectors 125. Together, the first and second shielding parts shield the tap selector 120 from external fields occurring outside the opening between the first and second shielding parts.

The first shielding part could advantageously be connected to the external contact 155, so that the first shielding part will be in electrical contact with the connected tap 110 when in use. By connecting the first shielding part in this manner, a large part of the diverter switch 115 will be at the same potential as the first shielding part, and therefore, the design of the tap changer can be simpler. However, the first shielding part could alternatively be connected to a current collector 125, so that, in a tap changer 100 having two current collectors 125, the first shielding part will alternatingly be at the potential of the connected fixed contact 135, and alternatingly at the potential of a fixed contact which is adjacent to the connected fixed contact 135. In this embodiment, the first shielding part will, in use, be electrically connected to the connected tap at half of the fixed contact positions of the moveable contact 130, assuming that the tap changer 100 has two current collectors 125. In yet another embodiment, the first shielding part is divided into two sections, each section being electrically connected to a different current collector 125 than the other section, and wherein the distance between the sections reaches or exceeds the adjacent-fixed-contact-insulation distance, here denoted $d_{step}$.

As explained above, the voltage between the fixed contacts 135 and the current collector 125 can take a value in the range $[0, U_{reg}]$, depending on which fixed contact 135 is currently connected. This range will be referred to as the regulation range. Thus, since the first shielding part will be electrically connected to the connected tap, the distance between the two shielding parts should preferably exceed the rated regulation voltage insulation distance in order to avoid flashover between the two shielding parts. At the same time, the smaller the distance between the two shielding parts, the better the external insulation. When the distance between the two shielding parts is constant, this distance should preferably be close to $d_{insul}^{end}$, and could typically lie in the range $[d_{insul}^{end}, 1.2d_{insul}^{end}]$. The optimal distance between the two shielding parts is often $d_{insul}^{end}$, but a larger distance may be desired, for example for reasons of ease of manufacture.

The versatility of the tap changer 100 could be increased even further if a constant distance between the two shielding parts and a constant contact gap is used: A tap changer 100, rated for a particular regulation range and having a set of N fixed contacts, could also be used to supply M fixed contacts with maintained rated regulation voltage, where M<N, since the shielding structure would then be designed to withstand the entire regulation voltage regardless of which fixed contact position operates as the end fixed contact position.

By providing a shielding structure comprising two shielding parts separated by a distance reaching or exceeding the rated regulation voltage insulation distance 100, the dimensioning of the tap selector 120 can be made mainly in dependence of the internal electric field, generated by the potential difference between the current collectors 125 and those of the fixed contacts 135 which are currently not connected (as well as between different fixed contacts 135). A compact design can be made so that separation of the internal field from the external field is achieved.

According to one embodiment of the invention, the tap changer 100 is designed so that in use, all the conducting parts of the tap changer 100 will be at a potential within the potential range of the regulating winding 105. That is, in this embodiment, no conducting part of the tap changer 100 is designed to be at earth potential. Since the external field is shielded from the tap selector 120 by means of the shielding structure, and no conducting part of the tap changer 100 is connected to earth, a design separation between the external insulation and the internal insulation is achieved. By this embodiment, the design and manufacturing of tap changers 100 for different voltage ratings can be much simplified, since only the internal insulation requirements have to be taken into account. The external insulation requirements can then be fulfilled by positioning of the tap changer 100 at a sufficient distance from any other objects at different potentials, such as the earth, the other phases of a transformer 200, the tap changers 100 serving these other phases, etc. Thus, the same tap changer design can be used in a wide variety of different external insulation requirements, as long as the tap changer fulfills the internal insulation requirements of a particular application.

In this embodiment, the tap changer can be provided with an electrically insulating attachment means for attaching the tap changer 100 to an insulation structure, for example an insulating suspension device or other insulating structure, which in turn is connected to earth. Different aspects of the insulating attachment means are further discussed in relation to FIGS. 6*a-b* and 7*a-c*.

Figure 3B:
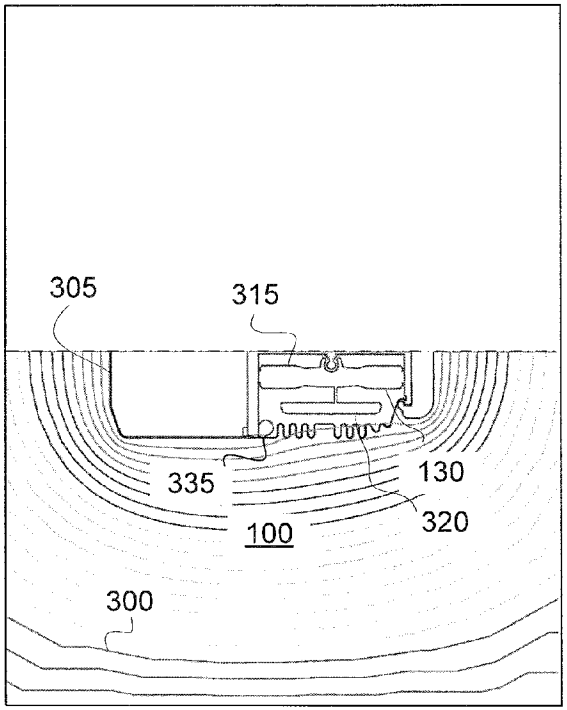
FIG. 3*b* illustrates the external electric field around a cross section of an embodiment of a tap changer along a plane, perpendicular to the extension direction of the tap changer, in a position where a moveable contact is currently connected (only half the tap changer is shown).
Figure 3A:
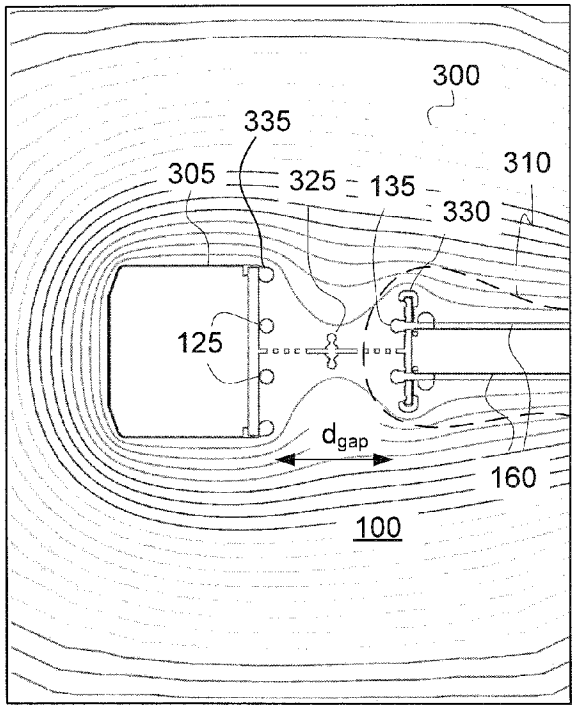
FIG. 3*a* illustrates the external electric field around a cross section of an embodiment of a tap changer along a plane, perpendicular to the extension direction of the tap changer, in a position where no moveable contact is currently located.
Figure 3C:
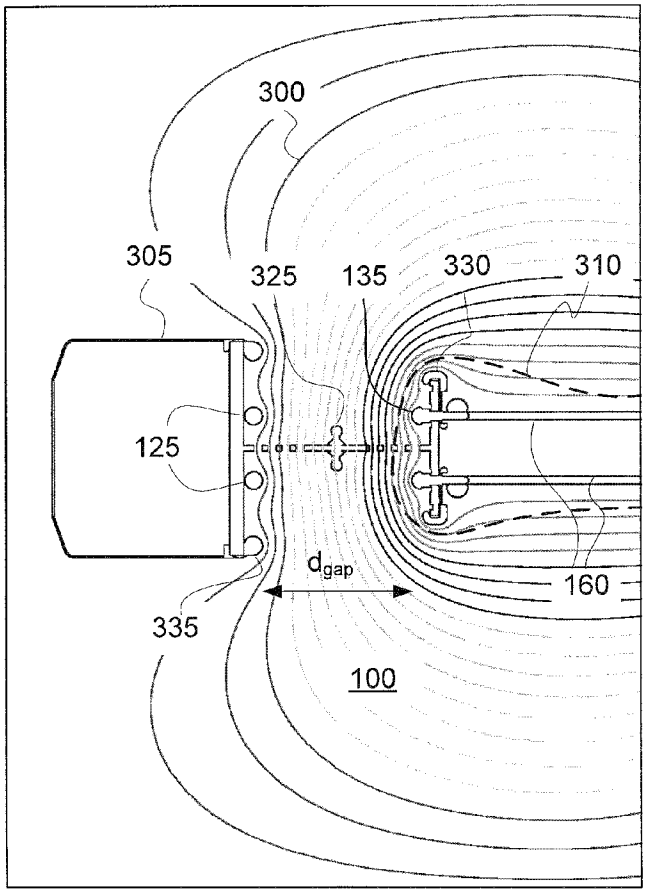
FIG. 3*c* illustrates the internal electric field for the view shown in FIG. 3*a*.

An example of a tap changer 100 having a shielding structure comprising a first and second shielding part according to the above is shown in FIGS. 3*a*-3*c*. The tap changer 100 of this example is a linear tap changer 100 having a linear arrangement of fixed contacts, where the fixed contacts are arranged two by two, so that two fixed contacts 135 are arranged side by side in a plane perpendicular to the extension direction of the linear arrangement, with further fixed contacts 135 arranged two by two above and/or below (a plane perpendicular to the extension direction will be referred to as a contact gap plane). The fixed contacts are thus arranged in two parallel rows which extend along the extension direction. A linear arrangement wherein the fixed contacts 135 are singly arranged along the extension direction of linear arrangement can alternatively be used, or a linear arrangement comprising two parallel rows of fixed contacts 135, where the fixed contacts 135 of one row are linearly displaced in relation to the fixed contacts 135 of the other row (cf. FIG. 1).

FIG. 3*a* and FIG. 3*b* show two cross sections of this tap changer embodiment along two different contact gap planes. The cross section of FIG. 3*a* is taken at a location where the moveable contact 130 is not currently present, whereas the cross section of FIG. 3*b* is taken through the moveable contact 130. Equipotential lines 300 of the external electric field have been obtained from simulations and are shown in the drawings. A first shielding part 305 is shown, which is arranged to be at the potential of the connected tap 110. The first shielding part 305 is arranged on the farther side of the current collectors 125 as seen from the fixed contacts 135. Hence, as can be seen, the external electric field at this side of the tap selector 120 is efficiently shielded. The second shielding part 310 is formed inter alia by the fixed contacts 135. Furthermore, the cables 160, connecting the different fixed contacts 135 to the different taps 110 of the regulating winding 105, also form part of the second shielding part 310. As can be seen in FIG. 3*a*, the second shielding part 310 efficiently shields the tap selector 120 from external electric fields at the father side of the fixed contacts 135 as seen from the current collectors 125. In order to optimize the shielding of the second shielding part 310, the cables 160 could be arranged perpendicularly to the current collector plane, away from the first shielding part 305 as shown in FIGS. 3*a* and 3*c*, the current collector plane being defined as a plane which includes the current collectors 125. However, the shielding obtained is typically not very sensitive to how the cables 160 are arranged.

Due to the opening between the first and second parts 305, 310 of the shielding structure, the space between the current collectors 125 and the fixed contacts 135 is not entirely shielded in the direction perpendicular to the contact gap $d_{gap}$ in the contact gap plane, this direction here referred to as the open direction. As can be seen in FIG. 3*a*, parts of the external electric field, here referred to as the leakage electric field, will be present in this space. However, the contribution from the leakage field in the direction of the internal electric field at the position of the fixed contacts 135 will be small compared to the magnitude of the internal electric field at this position, and can often be disregarded. The same applies at the position of the current collectors 125. A simulation of the internal electric field at the moveable contact position of FIG. 3*a* is shown in FIG. 3*c*. The space between the fixed contacts 135 and the current collectors 125 will hereinafter referred be to as the contact space.

At the centre of the contact gap $d_{gap}$, the leakage field will typically be somewhat higher. A moveable contact part 315, which includes the moveable contact 130, will, in a typical tap selector design, be located in this region. In order to allow for a simpler design of the moveable contact part 315, where geometries with poorer field grading properties could be used, further shielding may be provided in the region of the moveable contact part 315. In FIG. 3*b*, which shows only one half of the cross section of the tap changer 100, a moveable contact part 315 is shown, which in addition to the moveable contact 130 further comprises a shielding plate 320. The shielding plate 320 is in electrical contact with the moveable contact 130 and can be made from a conducting material, e.g. aluminum, steel, copper or brass. As can be seen from FIG. 3*b*, a shielding plate 320 arranged at the moveable contact part 315 can efficiently shield the external electrical field at the level of the connected fixed contact 135. (In the simulations performed to obtain the equipotential lines 300 of FIG. 3*b*, the cables 160 were not included as part of the second shielding part 310, which explains why the electric field in the region towards the exterior from the fixed contacts 135 differs between FIGS. 3*a* and 3*b*.)

The shielding plate 320 of FIG. 3*b* is arranged to be parallel to the extension direction and to the extension of the moveable contact 130 along the contact gap (here referred to as the contact gap direction, which is indicated in FIG. 1 by an x-axis). The shielding plate 320 is furthermore arranged on the outside of the moveable contact 130, i.e. on the side of the moveable contact 130 which faces the exterior of tap changer 100. In a tap changer 100 having two moveable contacts 130, each moveable contact part 315 could advantageously be provided with a shielding plate 320.

A shielding plate 320 can advantageously have a curved circumference, such as a circular, elliptic or oval circumference, in order to provide efficient shielding. The curvature of the circumference of the shielding plate 320 could for example correspond to a radius within the range of $0.2d_{gap}$-$0.45d_{gap}$ (a sufficient insulation distance from the shielding plate 320 to the fixed contacts 135, as well to the first shielding structure 305, will be required). A suitable circumference curvature could for example correspond to a radius of $0.35d_{gap}$. Furthermore, the edge of the shielding plate 320 could advantageously be curved and have an edge radius to further shield the external field, which could for example lie within the range 5-20 mm for a tap changer 100 rated for $U_m$ in the range of 30-120 kV.

Figure 4A:
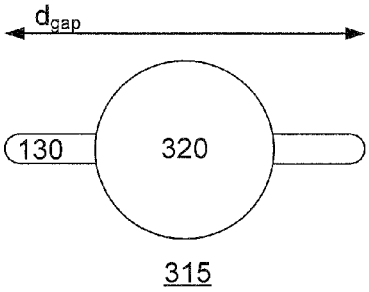
FIG. 4*a* is a side view of a moveable contact part including a moveable contact and a shielding plate.
Figure 4B:
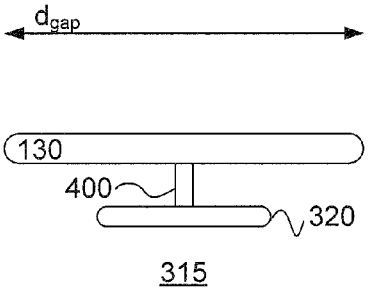
FIG. 4*b* is a top view of the moveable contact part of FIG. 4*a*.

FIGS. 4*a* and 4*b* schematically illustrate a moveable contact part 315 having a circular shielding plate 320 connected to a moveable contact 130 via a connector 400. The circumference curvature of the shielding plate 320 of FIGS. 4*a* and 4*b* corresponds to half the contact gap, $d_{gap}$. The shielding plate 320 can for example be attached to the moveable contact 130 by means of a metallic rod, screw or cable. The distance between the moveable contact and the shielding plate 320 could for example lie within the range 10-100 mm for a tap changer 100 rated for $U_m$ in the range of 30-120 kV. For a smaller radius of the plate, this distance is typically designed to be larger, and vice versa. Driving means for driving the moveable contact part 315 could at least partly be located between the shielding plate 320 and the moveable contact.

Now returning to FIG. 3*a* (and 3*c*), the second shielding part 310 is shown to include fixed-contact shields 330. A fixed-contact shield 330 of FIG. 3*a* is arranged to shield a fixed contact 135 from external electric field. The fixed-contact shield 330 therefore has a curvature in the contact gap plane with a convex surface facing away from the fixed-contact 135, towards the tap selector exterior. The tap changer 100 could advantageously include a set of fixed-contact shields 330 so as to increase the shielding capacity of the second shielding part 310, with one fixed-contact shield 330 for each fixed contact 135. In this way, high electric fields at the fixed contacts 135 can be avoided. A fixed-contact shield 330 is typically in electrical contact with the fixed contact 135 that it is arranged to shield. The fixed-contact shields 330 in a set of shields 330 will then be electrically separated from each other when the tap changer 100 is in use.

Figure 5:
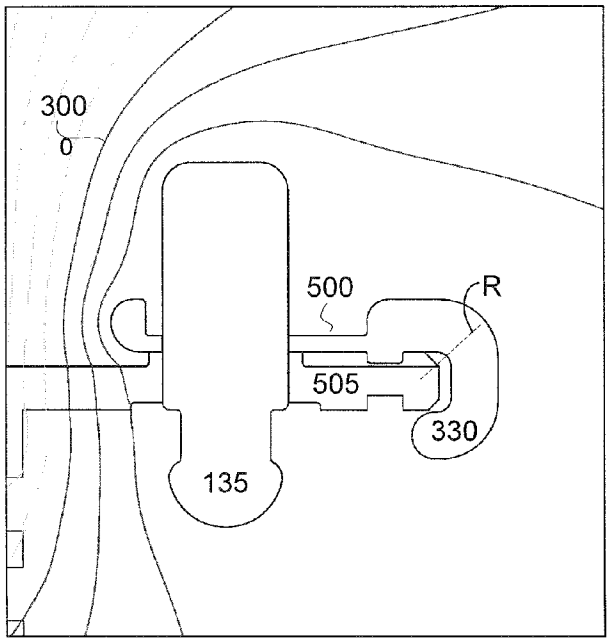
FIG. 5 is an illustration of a fixed contact provided with a fixed-contact shield.

A more detailed view of an example of a fixed contact 135 with an associated fixed-contact shield 330 is shown in FIG. 5. In the fixed contact arrangement of FIG. 5, the fixed-contact shield 330 is electrically and mechanically connected to the fixed contact 135. This could be achieved by inserting the fixed contact 135 through a hole in the shield 330 or vice versa. In the arrangement shown in FIG. 5, the fixed contact shield 330 comprises a rod 500, which provides a distance between the fixed contact 135 and the shield 330. In another embodiment, the fixed-contact shield 330 could be at least partly integrated in the fixed contact 135, so that the fixed contact 135 is of a field grading geometry which grades the external field in the open direction.

In FIG. 5, a radius R corresponding to the curvature of the fixed contact shield 330 has been indicated. R could for example lie within the range 10-40 mm for a tap changer 100 rated for $U_m$ in the range of 30-120 kV.

In FIG. 5, an insulating part 505 is shown, the purpose of which is to hold the fixed contacts 135 and the fixed-contact shields 330. The insulating part 505 could also be used for mechanically sealing the tap selector space from the surrounding, as further discussed below.

The contact space between the current collectors 125 and the fixed contacts 135 of a tap selector 120 can advantageously be free from any other electrically conducting parts than those forming part of the moveable contact part 315. By avoiding electrically conducting elements in the contact space, the design of the tap changer 100 can be more compact, since the distance between the current collector 125 and the fixed contacts 135 can then correspond to the insulation distance, $d_{insul}$, if desired. Oftentimes, this distance will correspond to $d_{insul}^{end}$.

Generally, the tap changer 100 comprises driving means for driving/guiding the movement of the moveable contact part 315 from one fixed contact position to another. In one embodiment, at least part of such driving means is located in the contact space. In such embodiment, the parts of the driving means that are located in the contact space could advantageously be made from an electrically insulating material. In FIGS. 3*a* (and *c*), part of a driving means located in the contact space has been indicated by reference numeral 325.

Figure 6B:
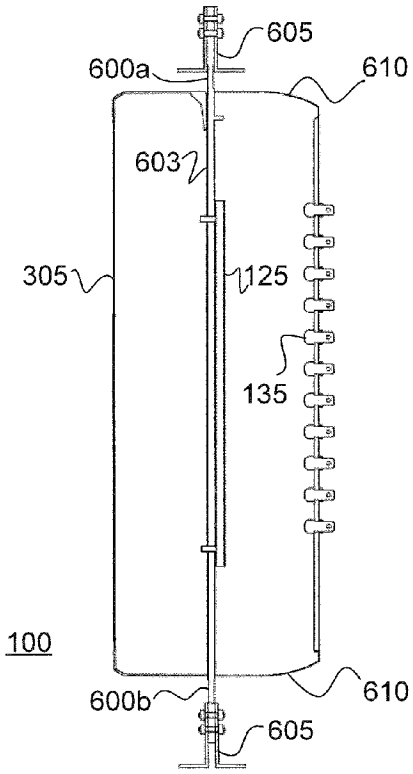
FIG. 6*b* is a schematic cross sectional side view of the tap changer of FIG. 6*a*.
Figure 6A:
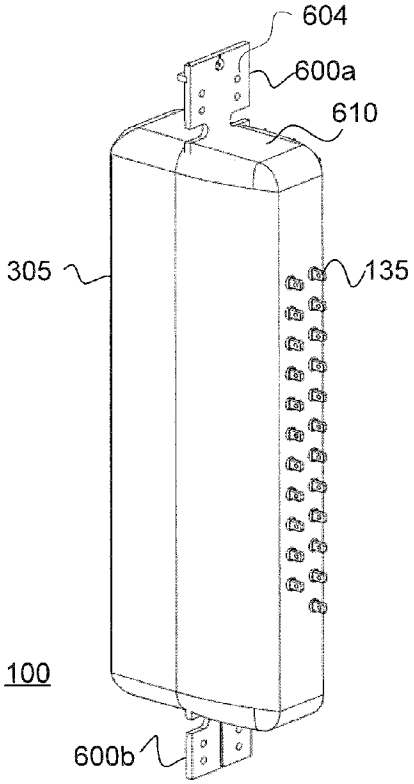
FIG. 6*a* is a schematic perspective view of an example of a tap changer.

FIG. 6*a* schematically illustrates a perspective view of an example of a tap changer 100. The tap changer of FIG. 6*a* includes an insulating attachment means 600 providing a fixation surface for attaching the tap changer 100 to a suspension structure. The attachment means 600 of FIG. 6*a* is in the shape of an insulating attachment plate, which comprises a top attachment part 600*a* and a bottom attachment part 600*b*.

The purpose of insulating attachment means 600 is, besides providing a means of securely attaching the tap changer 100 to an insulating structure, to electrically insulate the tap changer 100 from the insulating structure, so that all conducting parts of the tap changer 100 can be at a potential within the regulating winding potential range, as discussed above. The attachment means 600 would have to be sufficiently mechanically stable to carry the weight of the tap changer 100, as well as to withstand any forces exerted on the tap changer 100 in case of a ground fault situation. The attachment means 600 could for example be made from an insulating polymer such as epoxy, or polyester, or any other insulating material which is mechanically stiff and stable over time. The attachment plate 600 is shown in FIG. 6*a* is given as an example only, and other designs of the insulating attachments means 600 could alternatively be provided, such as an insulating attachment rod, etc.

FIG. 6*b* shows a side view cross section of the linear tap changer shown in FIG. 6*a*, where the cross section has been taken through a current collector 125 and a corresponding row of fixed contacts 135. In the example of FIG. 6*b*, the insulating plate 600 is arranged to extend through the tap changer interior in order to electrically separate the parts which are at the potential of the connected fixed contact 135, and those parts at the potential of the adjacent fixed contact potential. This extension of the insulating plate 600 is indicated in FIG. 6*b* by reference numeral 603. In another embodiment, the functionality of the extension 603 could be provided as a separate insulation plate, or could be omitted. If omitted, the distance between the parts at different potential would have to be increased accordingly.

FIG. 6*b* further shows an insulating beam structure 605 including an insulating joint, for attaching the tap changer 100, via the attachment means 600, to an insulating structure, which could for example be a suspension structure. The insulating beam structure 605 could form part of the tap changer 100, or of the suspension structure. The insulating beam structure 605 could for example include beams of I beam shape, L beam shape, U-beam shape, triangular beam shape, rectangular beam shape or of any other suitable beam shape. The insulating joint could for example include insulating stud bolts and nuts, arranged to go through holes in the attachment means 600 and the insulating beam structure 605, such holes for example being threaded. The insulating beam structure, including the insulating joint, could for example be made from epoxy or polyester.

Figure 7A:
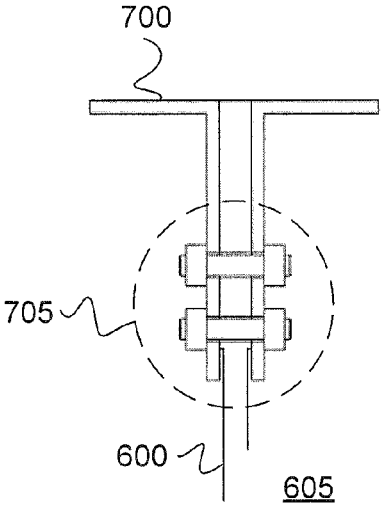
FIG. 7*a* is a cross sectional view of an L-shaped beam structure, by means of which a tap changer can be attached to an insulation structure, at a location where a tap changer is joined to the beam structure.
Figure 7B:
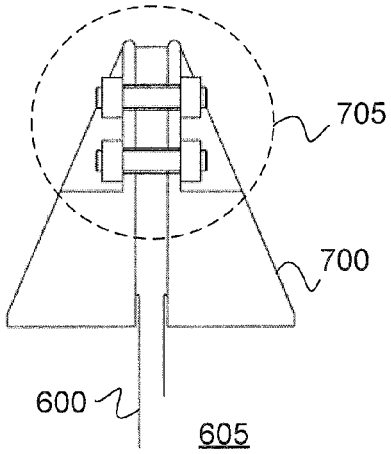
FIG. 7*b* is a cross sectional view of a triangular-shaped beam structure, by means of which a tap changer can be attached to an insulation structure, at a location where a tap changer is joined to the beam structure.

Examples of two different designs of the insulating beam structure 605 are illustrated in FIGS. 7*a* and 7*b*. FIG. 7*a* shows a cross section of an example of an insulating beam structure 605 including two beams 700 of L-shape, as well as an insulating joint 705 including insulating studs and bolts. FIG. 7*b* shows a cross section of an example of an insulating beam structure 605 which includes two triangular beams 705, in which a recess is provided where an insulating joint 705 can join the attachment means 600 of the tap changer 100 to the beam structure 605.

Since the electric field within the tap selector 120 in a high voltage tap changer 100 will be strong when the tap changer 100 is in use, there is a desire to keep the space occupied by the tap selector 120 free from dust, insects and other objects which may cause partial discharge and other problems. Thus, the tap changer 100 may include an electrically insulating structure forming an enclosure (possibly together with parts of the shielding structure), which mechanically separates the inside of (at least) the tap selector 120 from the exterior. Thus, the insulating structure 610 will be located, at least partly, in the open direction as seen from the tap selector interior, and typically also between or behind the fixed contacts 135 (cf. insulating part 505 of FIG. 5, which could form part of an insulating structure 610). An example of an insulating structure 610 is shown in FIGS. 6*a* and 6*b*.

Figure 7C:
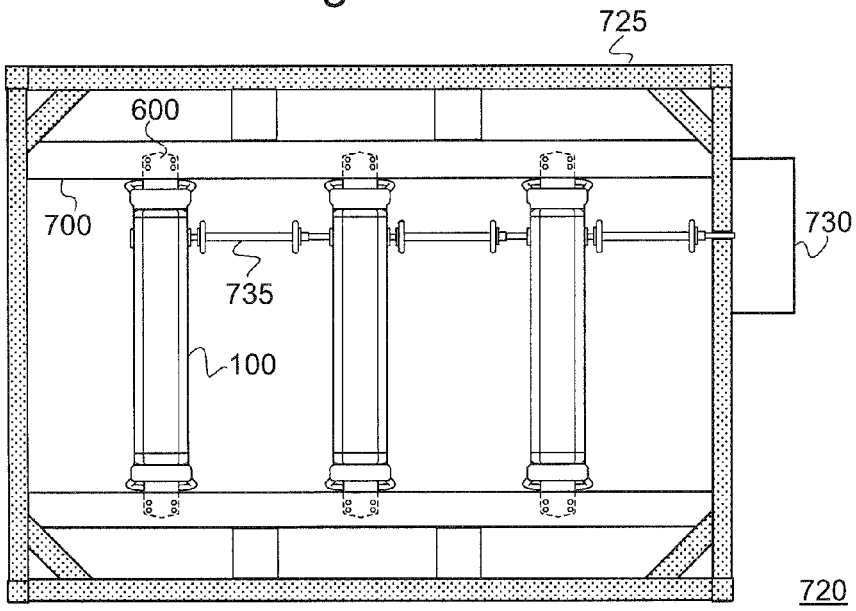
FIG. 7*c* schematically illustrates an example of a three-phase tap changer system wherein three tap changers are suspended in an insulation structure.

The tap changer 100 discussed above is arranged to provide tap changing possibilities to one phase in an AC system. In a three phase AC system, three tap changers 100 could for example be provided, each tap changer 100 providing tap changing functionality to a respective one of the three phases. An example of an embodiment of a three-phase tap changer system 720 comprising three tap changers 100 attached in an insulating beam structure 605 is schematically illustrated in FIG. 7*c*. For a single phase tap changer system 720, a similar arrangement for insulating the tap changer 100 from ground can be used. The insulating beam structure 605 of FIG. 7*c* is attached in a frame 725 which is at ground potential. The frame 725 could for example be made from steel or aluminium. The metal frame 725 of FIG. 7*c* is an example only, and any other design which provides mechanical stability could alternatively be used. The driving means of the tap changers 100 of FIG. 7*c* are connected to an electric motor 730 via electrically insulating shafts 735.

The tap changer examples of FIGS. 3*a-c* include a first shielding part 305 which forms a shielded space behind the current collectors 125, as seen from the fixed contacts 135. In this space, part or all of the diverter switch 115 and/or part or all of a gear unit for the driving mechanism can be located, the first shielding part 305 thus providing efficient external shielding of such equipment. The current collectors 125 can, if the separation between the current collectors 125 in the open direction is carefully designed, provide adequate shielding of this space from the internal electric field in the tap selector 120 (cf. FIG. 3*c*). If the distance required for withstanding the voltage demands over one step (i.e. for withstanding the voltage between two adjacent fixed contacts) is denoted $d_{step}$, the separation between the current collectors 125 in the open direction could for example lie within the range $[d_{step}; 2d_{step}]$. The smaller the distance, the better the internal shielding, and if possible, this distance should be at or slightly above $d_{step}$.

If desired, the transition resistors 150 of the diverter switch 115 can be located in a different volume than the main contacts 140 and the transition contacts 145. By moving the transition resistors 150 to a different volume than the contacts and the tap selector, cooling of the transition resistors 150 can be obtained in a more efficient manner. In an air insulated tap changer, the transition resistors 150 could for example be placed in a volume which forms a cooling duct, facilitating the cooling of the resistors. When the tap changer comprises an enclosure 610, such cooling duct could be separate to the volume enclosed by the enclosure 610, since the transition resistors 150 are less sensitive to dust etc than the transition contacts 145 and the tap selector 120. However, this need not apply to the transition resistors 150. Such air duct could be located in the shielded space formed by the first shielding part 305.

Figure 8:
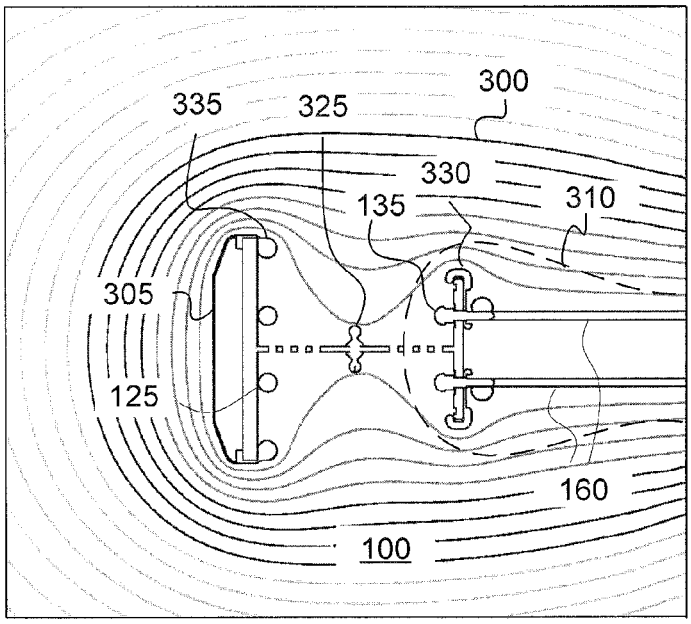
FIG. 8 illustrates the external electric field around a cross section of an embodiment of a tap changer along a plane, perpendicular to the extension direction of the tap changer, in a position where no moveable contact is currently located.

The first shielding part 305 could alternatively be designed so that the space between the first shielding part 305 and the current collectors 125 is smaller. An example of a tap changer having such first shielding part 305 is shown in FIG. 8, wherein the distance between the first shielding part 305 and the current collectors 125 along the contact gap direction approximately corresponds to the step distance, $d_{step}$. When a smaller distance is used, as in the example of FIG. 8, the diverter switch 115 could for example be located above the current collectors 125 in the extension direction in a conventional manner, or in any other suitable position. However, by locating the diverter switch 115 in the space between the first shielding part 305 and the current collectors 125, the extension of the tap changer 100 in the extension direction can be considerably reduced as compared to e.g. locating the diverter switch 115 above the current collectors 125. On the other hand, the tap changer 100 will be wider than if a more compact first shielding part is used.

The first shielding parts 305 shown in FIGS. 3*a*-3*c* and FIG. 8 includes an edge shield 335, which is arranged to provide a curvature in the contact gap plane with a convex surface facing away from the current collectors 125, towards the tap changer exterior. The edge shield 335 could advantageously extend along the edge of the first shielding part 305 in the extension direction. The edge shield 305 could for example be formed from a plate or sheet that makes up the main part of the first shielding part 305, or could be formed from a separate piece of conducting material, such as a rod, a pipe, an extruded profile or a casting.

Figure 9A:
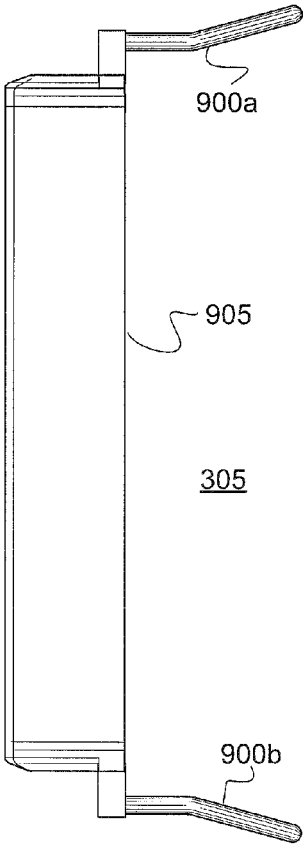
FIG. 9*a* is an illustration of an example of a first shielding part which, according to an embodiment of the invention, is provided with top and bottom shielding parts.
Figure 9D:
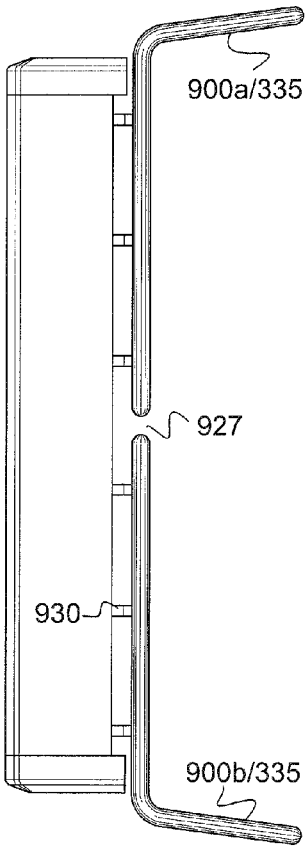
FIG. 9*d* is an illustration of another example of a first shielding part which is provided with top and bottom shielding parts.

In FIG. 9*a*, a side view of an example of a first shielding part 305 which includes a top shielding part 900*a* and a bottom shielding part 900*b* is shown. The main part of the first shielding part 305 has been indicated by reference numeral 905. The top/bottom shielding parts 900*a*, 900*b* are included so as to reduce the electrical field at the top and bottom areas of the contact space in the tap selector 120. FIG. 9*b* is a schematic cross sectional view of an example of a tap changer 100 along a plane which is parallel to the extension direction and parallel to the contact gap direction, wherein equipotential lines 300 of the external electric field, obtained from simulations, are shown. The parts 920 shown in the drawing are parts of a driving means, which parts are electrically conducting and located beyond the end fixed contacts 135*e* in the extension direction. As can be seen, these driving means parts 920 also contribute to the external shielding. However, if an embodiment of the driving means does not include such parts, they could be omitted, or replaced by another component providing shielding. The tap changer 100 of FIG. 9*b* is furthermore shown to include a cooling duct as discussed above in relation to the position of the resistors 150.

A top/bottom shielding part 900*a*, 900*b* extend out of the current collector plane, towards the linear arrangement of fixed contacts 135, at a position along the extension direction which lies beyond the position of the end fixed contact 135*e*. A top/bottom shielding part 900*a*, 900*b* has a convex surface facing away from the fixed contacts 135 and the current collectors 125 towards the tap changer exterior.

When an enclosing insulating structure 610 is included in the tap changer 100, as in FIGS. 9*a* and 9*b*, the tap changer 100 could advantageously be designed such that an air gap 915 is present between (most of) the insulating structure 610 and the top/bottom shielding parts 900*a*, 900*b*, in order to reduce any creepage currents in the insulating enclosure 610.

The top and bottom shielding parts 900 of FIGS. 9*a* and 9*b* are shown to be made from rods of circular cross section which are bent above the top/bottom area of the tap selector 120 in order to provide shielding from the external electric field. Other designs of the top and bottom shielding parts 900 could alternatively be used, such as a bent profile or a casting. The effective radius of the top and bottom shielding parts 900, as well as of the edge shield 335, should be selected to provide adequate shielding from the external electric field. For example, the effective radius could for example lie within the range of 15-100 mm for a tap changer 100 rated for $U_m$ in the range of 30-120 kV. The external field at the location of shields 900 and 335 will typically be of the same order of magnitude as the external field at the fixed-contact shields 330.

Figure 9C:
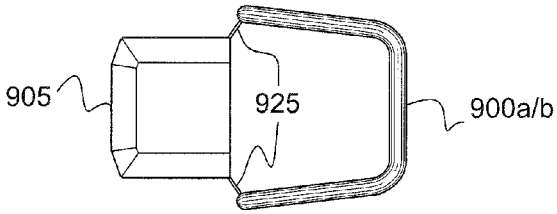
FIG. 9*c* is a top view of the first shielding part of FIG. 9*a*.
Figure 9B:
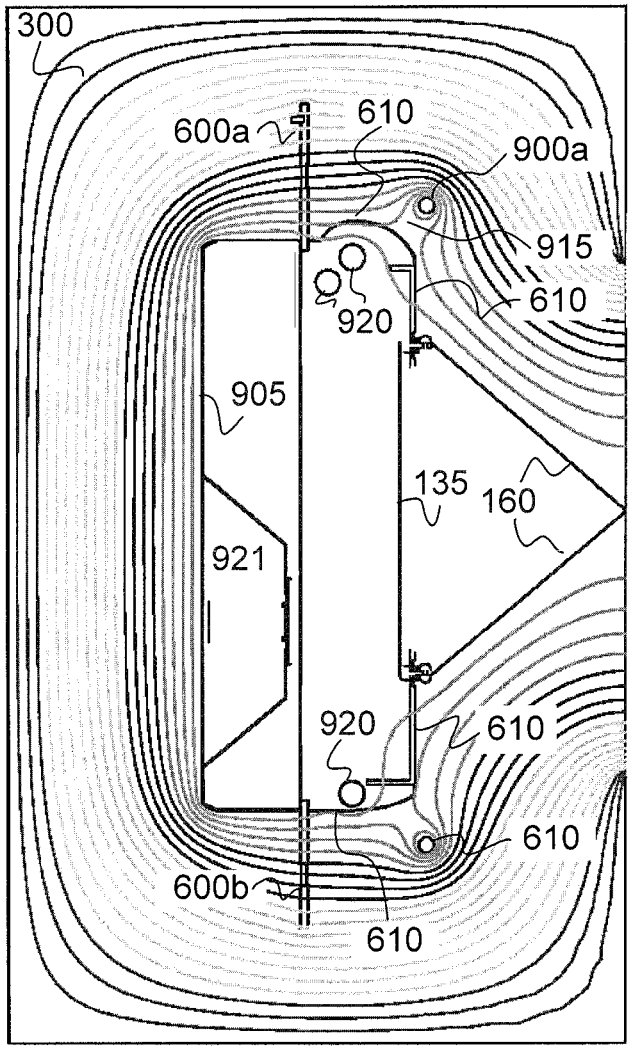
FIG. 9*b* schematically illustrates a cross sectional side view of an example of a tap changer including the first shielding part of FIG. 9*b*, wherein equipotential lines obtained from simulations are shown.

FIG. 9*c* is a top view of an example of a top/bottom shielding part 900*a/b*. The top/bottom shielding part 900*a/b* is electrically connected to the main part 905 of the first shielding structure 305 via electrical connections 925, here in the shape of metallic rods, which are of smaller cross-section than the top/bottom shielding part.

FIG. 9*d* illustrates an alternative embodiment of the top/bottom shielding parts 900*a/b*, wherein an edge shielding part 335 has been integrated in the top and bottom shielding parts 900*a/b*, respectively. A gap 927 is provided between the top and bottom shielding parts 900*a/b* in this embodiment, in order to make the shielding part easier to handle, and this gap could be omitted. The top/bottom shielding parts 900*a/b* are provided with attachment protrusions 930, as is the main part 905 of the first shielding structure. Alternative attachment arrangements could be used.

The first shielding part 305 is made from a conducting material, such as for example aluminum, steel, copper or brass, for example in the form of a sheet or plate that has been formed into the appropriate shape, in the form of an extruded profile, or a metal casting. The main part 905 of first shielding part 305 could advantageously be a hollow structure with a suitable radius to cope with the external field, as shown in FIGS. 3*a-c* and FIG. 8, where the hollow structure has an open side towards the current collectors 125. The depth of the hollowness of the first shielding part 305 could e.g. range from approximately one step distance, $d_{step}$ (cf. FIG. 8) to a number of step distances, so that the shielded space provided by the first shielding part 305 is large enough to house the diverter switch (cf. FIGS. 3*a-c* and FIGS. 9*a-d*). In another embodiment, the first shielding part 305 does not provide for a hollowness, i.e. the depth of the hollowness is zero.

In FIGS. 3*a-c* and FIG. 8, the main part 905 is shown to be of more or less rectangular shape with curved corners. Other shapes could alternatively be used, such as e.g. part of a circular or elliptic cylinder that is open along its axis. At least a major part of the first shielding part 105 will typically be arranged on the farther side of the current collector(s) as seen from the arrangement of fixed contacts. In some implementations, the first shielding part will extend, from the farther side of the current collectors, beyond the current collector plane. Such extension would typically be small, for example less than half the contact gap or smaller.

The extension of the first shielding part 305 in the extension direction, also referred to as the length of the first shielding part 305, could advantageously be larger than the extension of the set of fixed contacts 135 in this direction, as shown in FIGS. 6*a-b* and FIG. 9*b*. The extension of the first shielding part 305 in the open direction (perpendicular to contact plane), also referred to as the width of the first shielding part 305, could advantageously be equal to or exceed the extension of (the set of) current collector(s) 125 in this direction, cf. FIGS. 3*a-c* and FIG. 8. When the first shielding part 305 is implemented as one section per current collector, this corresponds to the extension of the set of first shielding part sections in this direction being equal to, or exceeding, the extension of the set of current collectors 125.

The above described tap changer 100 has been described in relation to a linear regulating winding 105. However, the invention is independent on the type of regulating winding 105, and could equally well be applied to a regulating winding 105 providing plus-minus and/or coarse-fine regulation possibilities. For plus-minus or coarse-fine regulating windings 105, a change-over selector could be added in a conventional manner.

As mentioned above, the first shielding part 305 could, if desired, be divided into one section per current collector, such sections thus taking different potentials, the sections of the first shielding part 305 being separated by a distance which reaches or exceeds $d_{step}$.

The invention has been described in terms of a tap changer 100 having two current collectors 125. It could however also be applied to a tap changer 100 having a single current collector 125, such tap changer also having a single moveable contact part 315 and a single row of fixed contacts 135, or a tap changer 100 having three or more current collectors 125.

The invention is particularly beneficial in on-load tap changers 100, where the regulation of the transformer output voltage takes place while the transformer 200 is in operation. However, a tap changer 100 according to the invention could equally well be used in a non-excited, off-load tap changer.

Since the insulation distances are so much larger in air than in oil, the benefits of a compact design are more pronounced in an air insulated tap changer. However, the invention can advantageously be applied also in oil insulated designs, which will then show outstanding insulation properties.

The invention will be useful for air insulated tap changers in a large Um range. An example of an Um range for which the invention is useful in an air insulated tap changer is the range of 30-150 kV. The invention can also be used for other Um voltages, but the overall size of the equipment will increase with increasing voltage, which may lead to practical difficulties for high voltages. In an oil insulated tap changer, the size of the equipment will be considerably smaller, and the invention can be used without practical restrictions for a larger voltage range, for example up to 600 kV and above.

Although various aspects of the invention are set out in the accompanying independent claims, other aspects of the invention include the combination of any features presented in the above description and/or in the accompanying claims, and not solely the combinations explicitly set out in the above description.

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

What is claimed is:

1. A tap changer for connection to a regulating winding of a rated regulation voltage, the tap changer having a tap selector; wherein the tap selector comprises:

a set of linearly arranged fixed contacts comprising at least two fixed contacts, each arranged to be connected to a tap of the regulating winding;

at least one current collector; and at least one movable contact part having a moveable contact arranged to electrically bridge a contact gap between a current collector and a fixed contact, a moveable contact part being linearly moveable along a current collector;

the tap changer further comprising:

a shielding structure arranged to shield the tap selector from an external electrical field; wherein the shielding structure comprises:

a first shielding part for shielding the tap selector mainly from external electrical fields occurring behind the current collectors as seen from the fixed contacts, the first shielding part being arranged to be electrically connected to the connected tap of the regulating winding; and a second shielding part formed at least partly by the fixed contacts;

wherein the first and second shielding parts are separated so that the distance between the first and second shielding parts reaches or exceeds the rated regulating voltage insulation distance of the tap changer.

2. The tap changer of claim 1, wherein the first shielding part comprises a hollow structure having an open side towards the current collectors.

3. The tap changer of claim 1, wherein the space formed between the current collector and the arrangement of fixed contacts contains no conducting parts, apart from conducing parts forming part of the moveable contact part.

4. The tap changer of claim 1, wherein the moveable contact part comprises at least one shielding plate arranged between the moveable contact and the exterior of the tap changer, in order to shield the movable contact from the external electrical field.

5. The tap changer of claim 1, wherein the second shielding part comprises a set of fixed-contact shields, each fixed-contact shield being arranged to shield a fixed contact, a fixed-contact shield having a curvature in the contact gap plane with a convex surface facing away from the fixed-contact towards the tap changer exterior, the fixed-contact shields being electrically separated from each other.

6. The tap changer of claim 1, wherein the first shielding part comprises an edge shield having a curvature in the contact gap plane with a convex surface facing away from the current collector towards the tap selector exterior, the edge shield extending along a direction parallel to the current collector(s).

7. The tap changer of claim 1, further comprising an electrically insulating structure arranged to prevent undesired matter from entering the tap selector.

8. The tap changer of claim 1, wherein the first shielding part comprises a top and/or a bottom shielding part, where the top/bottom shielding part extends out of the current collector plane, towards the linear arrangement of fixed contacts, at a position along the extension direction which lies beyond the position of the end fixed contact, the top/bottom shielding part having a convex surface facing away from the fixed contacts and the current collector(s) towards the tap changer exterior.

9. The tap changer of claim 8, wherein the top/bottom shielding part is formed from a bent rod.

10. The tap changer of claim 8, further comprising an electrically insulating structure arranged to event undesired matter from entering the tap selector, wherein the insulating structure comprises a top and/or bottom insulating part which is located between the top/bottom shielding part and the arrangement of fixed contacts, and separated from the top/bottom shielding part by means of an air gap in order to reduce any creepage current.

11. The tap changer of claim 1, wherein all conducting parts of the tap changer are arranged to be at an electrical potential within the potential range of the regulating winding when the tap changer is in use.

12. The tap changer of claim 1, wherein no part of the tap changer is arranged to be at earth potential.

13. The tap changer of claim 12, further comprising an electrically insulating attachment means for attaching the tap changer to an insulating structure.

14. The tap changer of claim 1, wherein the distance between the first and second shielding parts is larger than, or equal to, the contact gap, so that the distance between the current collector and the fixed contacts at the two ends of the linear arrangement is the shortest distance over which the entire regulation voltage will occur during operation of the tap changer.

15. The tap changer of claim 1, wherein the tap changer comprises a first and a second current collector arranged in parallel;

the linear arrangement of fixed contacts comprises a first and a second line of fixed contacts, said first and second lines being arranged in parallel; and the tap changer comprises a first and a second moveable connector, the first moveable connector is arranged to bridge the gap between the first current collector and the first line of fixed contacts, while the second moveable connector is arranged to bridge the gap between the second current collector and the second line of fixed contacts.

16. The tap changer of claim 1, wherein the tap changer is a diverter switch tap changer having a diverter switch.

17. The tap changer of claim 16, wherein the first shielding part is arranged to shield at least part of the diverter switch, the diverter switch being located in a space between the first shielding part and the current collector, behind the current collector as seen along a contact plane from the arrangement of fixed contacts.

18. The tap changer of claim 1, wherein the tap changer is an on-load tap changer.

19. The tap changer of claim 1, wherein the tap changer is arranged to be insulated by means of air or an air-like gas.

* * * * *